United States Patent [19]

Warehime

[11] 4,336,942

[45] Jun. 29, 1982

[54] 3-WAY MINI-TENNIS GAME AND APPARATUS

[76] Inventor: Norwood R. Warehime, 704 W. 34th St., Baltimore, Md. 21211

[21] Appl. No.: 189,733

[22] Filed: Sep. 22, 1980

[51] Int. Cl.[3] ..... A63B 71/02

[52] U.S. Cl. ..... 273/411; 273/342; 273/348

[58] Field of Search ..... 273/411, 30, 342, 348

[56] References Cited

U.S. PATENT DOCUMENTS

| | | | |
|---|---|---|---|
| 1,258,931 | 3/1918 | Newcombe | 273/342 X |
| 2,008,359 | 7/1935 | Lamb | 273/342 X |
| 2,163,456 | 6/1939 | Youngberg | 273/342 |
| 2,545,615 | 3/1951 | Hatley | 273/411 X |
| 2,688,484 | 9/1954 | Garber | 273/411 X |
| 3,452,985 | 7/1969 | D'zmura | 273/30 |
| 3,655,187 | 4/1972 | Pugsley | 273/30 |
| 3,945,641 | 3/1976 | Carbonero | 273/30 X |
| 4,108,434 | 8/1978 | Royer | 273/30 |

*Primary Examiner*—William H. Grieb

[57] ABSTRACT

A 3-way mini-tennis game and apparatus therefor, wherein game is played by three players or teams on a hard, smooth, and level surface using a small resilient play ball, three or six paddles or rackets, and a special 3-way ball passage defining structure placed in center of playing area on playing surface. The special structure in a preferred embodiment of the invention comprises three circular type hoops fastened together with stiff spring clips to form an upright regular pyramidal tripod, with sides of structure making a 60° angle with playing surface, as measured within structure. Other optional shapes and materials can be used to form sides of structure, or a unitary, self-supporting 3-way ball passage defining pyramidal tripod structure can be used. No barrier nets are required. In general, game apparatus is safe, inexpensive, portable, and easy to set-up. Little or no boundary lines or court markings are needed. Singles or doubles can play game. In general, game play requires that each pass of ball, when hit by paddle or racket, go cleanly through two open areas of sides of 3-way structure. Fault assessments and point score awards are somewhat like those for paddle or table tennis. Game can be played indoors or outdoors.

12 Claims, 8 Drawing Figures

3-WAY MINI-TENNIS GAME AND APPARATUS

DESCRIPTION

1. Technical Field

The invention relates to a 3-way mini-tennis game and apparatus therefor; a game is played by three players or teams on a hard, smooth, and level floor surface using a small resilient play ball, three or six paddles or rackets, and a 3-way ball passage defining means, said means, in a preferred embodiment of the invention, comprises three circular type hoops fastened together with spring clips to form an upright regular pyramidal tripod structure. Players must hit ball through any two hoops, without ball touching hoops, for a valid pass. Ball can take any number of bounces. General game play is somewhat similar to paddle tennis or table tennis.

2. Background Art

No directly related game and apparatus has been noted. U.S. Pat. No. 3,452,985 discloses various 3-way game court layouts using radially extending net barriers but no ball passage defining hoops. U.S. Pat. No. 4,108,434 discloses a table tennis game table with four radially extending nets plus a central cylindrical member acting as an addition barrier but uses no hoops. U.S. Pat. No. 3,655,187 discloses a pair of slightly separated tables with a net barrier and a ball passage defining hoop (barrier) between tables. Game play is similar to table tennis, with only 2-way game play. U.S. Pat. No. 3,945,641 discloses various 2-way game play court layouts using both net and ball passage defining arch (barrier), but has no 3-way layout.

DISCLOSURE OF INVENTION

The invention as claimed is intended to provide a new approach to 3-way tennis type game play and apparatus therefor. It solves the problem of how to design a simple 3-way ball passage defining structure which represents the main central game apparatus (barrier) in game play. No nets are used.

The advantages offered by the invention are mainly that the elaborate net barrier structure is eliminated and that three identical frame elements, such as circular hoops, inverted "U" shapes, rectangle shapes, or the like, can be easily fastened together with spring clips to form an effective, inexpensive, and self-supporting 3-way ball passage defining tripod structure. An optional unitary tripod structure may also be used in place of the assembled tripod structure. In general, the novel game apparatus is safe, inexpensive, portable, and easy to set-up. Game court can be on any hard, smooth, and level surface, and requires little or no court layout markings. Game play by single or doubles is safe, dynamic, and suitable for a broad range of player types. Games can be played indoors or outdoors.

BRIEF DESCRIPTION OF DRAWINGS

Details of invention are described in connection with the accompanying drawings, in which.

DESCRIPTION AND PREFERRED EMBODIMENT FOR CARRYING OUT INVENTION

Figure 1:
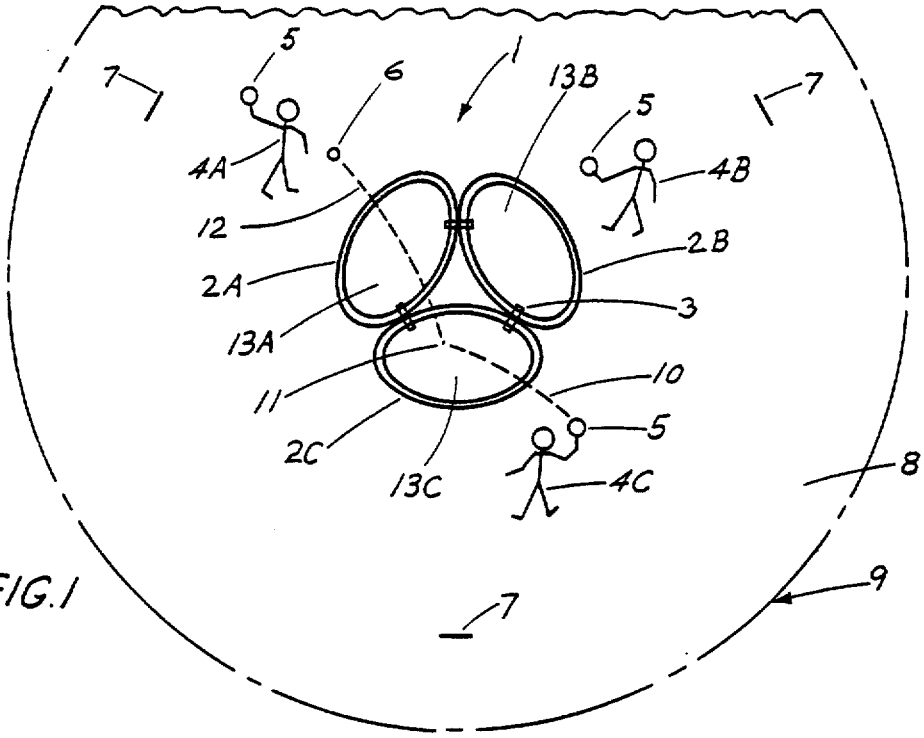
FIG. 1 is a schematic view from an upper angle of the game court layout showing player positions and game apparatus.

FIG. 1 shows a preferred embodiment of invention, in which numeral 1 generally indicates a 3-way ball passage defining pyramidal structure comprising three closed circular hoops 2A, 2B, 2C attached together by three fastening means 3, with structure 1 disposed in an upright position on playing surface 8 in center of playing area generally indicated by numeral 9. Three competing players 4A, 4B, 4C are positioned properly in front of hoops 2A, 2B, 2C respectively. Each player has a striking bat, that is, a paddle or racket 5. FIG. 1 indicates that player 4C has just hit small, resilient play ball 6 with striking bat 5 through hoop opening 13C or hoop 2C via path 10, with ball striking playing surface 8 at spot 11, and rebounding via path 12 and through hoop opening 13A of hoop 2A. Player 4A must next return ball 6 cleanly through any two hoop openings following strike with bat for valid game play. Again, receiving player must return ball in a similar manner. Such play continues until a fault is made by a player. Play ball 6 can take any number of bounces so long as it passes through any two hoop openings without touching a hoop. A player failing to return ball properly or hitting any hoop with ball or bat is assessed a fault.

Game play is started with serve from one of the marker lines 7 in each player area, set back 2 yards (or 2 meters) from center of hoop base of structure 1. Served ball must strike playing surface 8 before passing through any hoop for serve to be valid. Only one serve is allowed. Improper serve results in a fault.

The preferred embodiment for structure 1 comprises three circular hoops of rigid tubular plastic about $\frac{3}{4}$ inches (2.0 cms) cross sectional diameter, with hoop outside diameters of about 20 to 60 inches (50.8 to 152.4 cms). The hoop fastening means 3 can be stiff spring-clips or any other types of suitable fasteners. The hoops are fastened in such a manner to form a regular pyramidal structure with planes of hoops making 60° angles with the playing surface, as measured within structure. Marks on hoops can indicate proper fastening points. Structure 1 is self-supporting for assembled type game apparatus.

Figure 2:
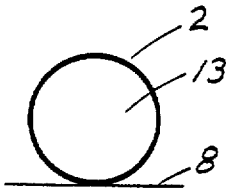
FIGS. 2–7 are schematic views of various simple geometric frame shapes that can be used for assembly of a 3-way ball passage defining tripod structure.
Figure 3:
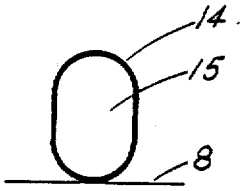
Figure 4:
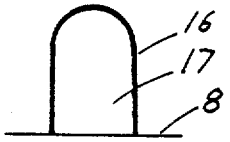
Figure 5:
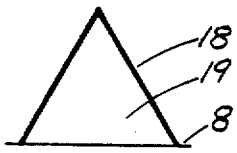
Figure 6:
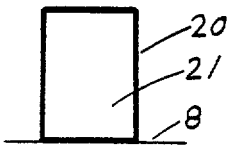
Figure 7:
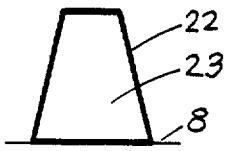
Figure 8:
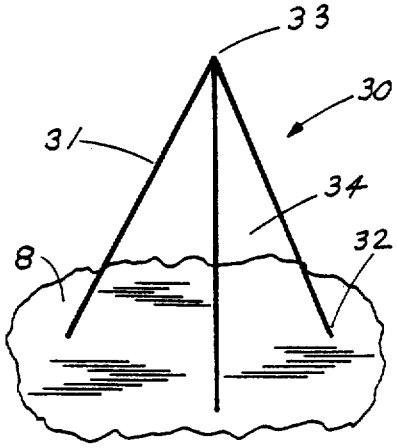
FIG. 8 is a schematic view of a unitary, self-supporting 3-way ball passage defining tripod structure.

FIGS. 2–7 show various simple geometric frame shapes suitable for use in assembly of a 3-way ball passage defining tripod structure such at 1. In all FIGS. 2–7, numeral 8 represents playing surface level to establish proper orientation for frame shape in assembly. FIG. 2 shows the preferred embodiment frame 2, in form of a circular hoop with opening 13; FIG. 3 shows oval frame 14 with opening 15; FIG. 4 shows inverted "U" frame 16 with opening 17; FIG. 5 shows inverted "V" frame 18 with opening 19; FIG. 6 shows rectangular frame 20 with opening 21; and FIG. 7 shows trapezoidal frame 22 with opening 23. FIG. 8 shows schematic view of unitary, self-supporting 3-way ball passage defining tripod pyramidal structure generally represented by numeral 30 which is disposed upright on playing surface 8. Structure leg elements 31 rest on feet 32, with leg elements united at apex 33, and ball passage openings 34 defined by legs 31 and playing surface 8. Structure 30 can be assembled from rigid plastic tubing and fittings, or can be made with telescoping rigid plastic or metal tubing, possibly with hinged leg connections at apex and restraining members connected from foot to foot at base. Permanent rigid structures could also be fabricated from metal or wood rod or pipe members. Sides of structure 30 should form an angle of about 60° with playing surface 8, as measured within structure.

In game play example, assume singles play. Decide serving order. Server stands at service marker 7 and hits ball with paddle and tries to drive it through any two hoop openings without touching hoops. Ball on serve must, however, touch playing surface before passing through any hoop opening. Only one serve is allowed. If serve is missed in any way, a fault is assessed server and each opponent receives one point score. If serve is good, the player adjacent to hoop opening where ball exists must return ball. Ball in play at any time can take any number of bounces, or can be strictly an aerial shot, except on serve. Ball return can be directed at any two hoop openings. If player fails to make a return shot, player that delivered shot that was missed is awarded a one point score. Serve is rotated after each fault. Game play continues to end of time period or exact number of serve rounds. A summary of scoring rules is as follows; (a) fault on serve when ball hits hoop, fails to pass through two hoops, or fails to make at least one bounce before entering a hoop results in a one point score award to opponents of server; (b) fault on return of any ball give player who last hit ball properly a one point score; (c) fault caused by player hitting any hoop with ball, paddle, or his limbs or body results in a one point score award to opponents; (d) fault on serve from wrong position results in a one point score award to opponents. Player with most points at end of time period or after exact number of serve rounds is winner. If score is tie, hold 2 or 3-way play-off. In 2-way play, adjust above scoring rules logically as needed. In doubles play, partners alternate serves. Optional rule can require partners to alternate all shots. Game can also be played without paddles or rackets by using hands and a handball. No actual playing court boundary markings are required. Service marker lines can be temporary or permanent type. A small marker spot may also be placed on playing surface to show center of game area.

The invention has been shown and described herein in what is considered to be the most practical and preferred embodiment. It is recognized, however, that departures may be made therefrom within the scope of the invention and that obvious modifications will occur to a person skilled in the arts.

I claim:

1. A 3-way mini-tennis game and apparatus therefor, wherein the apparatus comprises a small, lightweight resilient play ball, at least three striking bats, a playing surface means, said playing surface means including a game area means, and a 3-way ball passage defining means, said 3-way ball passage defining means being disposed in a general upright position on said playing surface means and in center of said game area means, said 3-way ball passage defining means comprises three identical ball passage defining elements, with each of said defining elements abutting the other two said defining elements, said defining elements being held together in a regular tripod type pattern by fastening means at points of abutment of said defining elements, each of said defining elements in said tripod type pattern being in a separate plane, each said separate plane forming an angle not less than 30° nor more than 90° with plane of said playing surface means, each said angle being measured within the said tripod type pattern, each of said defining elements of said 3-way ball passage defining means being in the form of a circuitous, rigid frame with a generally central open area, each said open area being of a sufficient size to allow said play ball to readily pass through each said open area of each said frame in game play involving at least three competing players.

2. A 3-way mini-tennis game and apparatus according to claim 1 wherein each said circuitous, rigid frame comprises a member formed into a closed circular hoop having an outside hoop diameter of about 20 to 60 inches (50.8 to 152.4 cms), and said member having all of its cross sectional dimensions less than 4 inches (10.1 cms).

3. A 3-way mini-tennis game and apparatus according to claim 1 wherein each said circuitous, rigid frame comprises a member formed in a closed oval shaped hoop having a maximum outside hoop dimension of 60 inches (152.4 cms), and said member having all of its cross sectional dimensions less than 4 inches (10.1 cms).

4. A 3-way mini-tennis game and apparatus according to claim 1 wherein each said circuitous, rigid frame comprises a member formed into an inverted "U" having a maximum height dimension of 60 inches (152.4 cms), and said member having all of its cross sectional dimensions less than 4 inches (10.1 cms).

5. A 3-way mini-tennis game and apparatus according to claim 1 wherein each said circuitous, rigid frame comprises a member formed into an inverted "V" having a maximum side length dimension of 60 inches (152.4 cms), and said member having all of its cross sectional dimensions less than 4 inches (10.1 cms).

6. A 3-way mini-tennis game and apparatus according to claim 1 wherein each circuitous, rigid frame comprises a member formed into a rectangle having a maximum side length dimension of 60 inches (152.4 cms), and said member having all of its cross sectional dimensions less than 4 inches (10.1 cms).

7. A 3-way mini-tennis game and apparatus according to claim 1 wherein each said circuitous, rigid frame comprises a member formed into a trapezoid having a maximum side length dimension of 60 inches (152.4 cms), and said member having all of its cross sectional dimensions less than 4 inches (10.1 cms).

8. A 3-way mini-tennis game and apparatus according to claim 1 wherein said game area means comprises a clear circular area of at least 30 feet (approx. 9 mts) in diameter, and said playing surface means comprises a hard, smooth, and level surface on which base of said 3-way ball passage defining means and feet of said competing players are normally positioned.

9. A 3-way mini-tennis game and apparatus therefor, wherein the apparatus comprises a small, lightweight resilient play ball, at least three striking bats, a playing surface means, said playing surface means including a game area means, and a 3-way ball passage defining means, said 3-way ball passage defining means being disposed in a general upright position on said playing surface means and in center of said game area means, said 3-way ball passage defining means comprises a regular pyramid shaped tripod structure with maximum base-to-apex height dimension of 60 inches (152.4 cms), said structure being formed from rigid rods united at apex of said structure, each side of said structure being in a separate plane forming an angle not less than 30° nor more than 90° with plane of said playing surface means, each said angle being measured within said structure, each of said side of said structure having a generally open area, each said open area being of sufficient size to allow said play ball to readily pass through said open area in game play involving at least three competing players.

10. A 3-way mini-tennis game and apparatus according to claim 9 wherein said game area means comprises a clear circular area of at least 30 feet (approx. 9 mts) in diameter, and said playing surface means comprises a hard, smooth, and level surface on which base of 3-way ball passage defining means and feet of said competing players are normally positioned.

11. A 3-way mini-tennis game and apparatus therefor, wherein the apparatus comprises a small, lightweight resilient play ball, at least three striking bats, a playing surface means, said playing surface means including a game area means, and a 3-way ball passage defining means, said 3-way ball passage defining means being disposed in a general upright position on said playing surface means and in center of said game area means, said 3-way ball passage defining means comprises a 3-sided frame type structure, said sides of said structure being substantially identical in form and disposed in a uniform space relationship about a center axis of said structure, said axis being normal to said playing surface means, said sides of said structure having an angular orientation within 45° of vertical and a generally central open area of sufficient size to allow said play ball to readily pass through said open area of any two said sides of said structure in one continuous pass of said play ball in game play involving at least three competing players.

12. A 3-way mini-tennis game and apparatus according to claim 11 wherein said game area means comprises a clear circular area of at least 30 feet (approx. 9 mts) in diameter, and said playing surface means comprises a hard, smooth, and level surface on which base of said 3-way ball passage defining means and feet of said competing players are normally positioned.

* * * * *